US008453897B2

(12) United States Patent
Burton

(10) Patent No.: US 8,453,897 B2
(45) Date of Patent: Jun. 4, 2013

(54) LAPTOP HOLDING DEVICE

(76) Inventor: Todd Burton, Riverdale, IL (US)

( * ) Notice: Subject to any disclaimer, the term of this patent is extended or adjusted under 35 U.S.C. 154(b) by 274 days.

(21) Appl. No.: 12/947,204

(22) Filed: Nov. 16, 2010

(65) Prior Publication Data

US 2012/0118925 A1 May 17, 2012

(51) Int. Cl.
*A45C 15/00* (2006.01)

(52) U.S. Cl.
USPC ..... 224/581; 224/648; 224/199; 224/637; 224/663; 224/679; 224/259

(58) Field of Classification Search
USPC ..... 224/195, 197, 199, 660, 663, 255, 224/256, 270, 648, 646, 581, 582, 637, 262, 224/930, 153, 679, 259; 108/43
See application file for complete search history.

(56) References Cited

U.S. PATENT DOCUMENTS

| | | | | |
|---|---|---|---|---|
| 5,447,215 | A | 9/1995 | Volkmar | |
| 5,706,992 | A | 1/1998 | Moor | |
| 5,762,250 | A | 6/1998 | Carlton | |
| 6,269,948 | B1 | 8/2001 | Jackson | |
| 6,354,477 | B1 | 3/2002 | Trummer | |
| 6,431,424 | B1 * | 8/2002 | Smith | 224/583 |
| 6,619,519 | B1 * | 9/2003 | Nix et al. | 224/153 |
| 2007/0295774 | A1 * | 12/2007 | Matschke | 224/581 |
| 2010/0108726 | A1 * | 5/2010 | Hilgenberg | 224/153 |
| 2010/0116860 | A1 * | 5/2010 | Tello | 224/576 |
| 2010/0230458 | A1 * | 9/2010 | Kramer | 224/581 |
| 2011/0127304 | A1 * | 6/2011 | Kam | 224/153 |
| 2011/0278337 | A1 * | 11/2011 | Chiu | 224/637 |

* cited by examiner

*Primary Examiner* — Nathan J Newhouse
*Assistant Examiner* — Scott McNurlen
(74) *Attorney, Agent, or Firm* — Michael L. Greenberg, Esq.; Greenberg & Lieberman, LLC

(57) ABSTRACT

A combination carrying case and workstation platform for an electronic device such as a laptop computer. The present invention is worn as a backpack, and designed so that the case can be moved to the front of the user's body by means of straps that encircle the user. The straps serve as the tracks upon which the case is moved from the rear of the user's body to the front. When moved to the user's front, the case can be folded down to form a workstation platform on which the electronic device can be used. Because the present invention hangs suspended from the strap system on the user's body, the user's hands are left free to operate the electronic device.

7 Claims, 6 Drawing Sheets

LAPTOP HOLDING DEVICE

FIELD OF THE PRESENT INVENTION

The present invention provides a user a wearable carrying case and platform for an electronic device such as a laptop computer. The present invention is worn as a backpack, and designed so that the case can be moved to the front of the user's body by means of straps that encircle the user. The straps serve as the tracks upon which the case is moved from the rear of the user's body to the front. When moved to the user's front, the case can be folded down to form a workstation platform on which the electronic device can be used. Because the present invention hangs suspended from the strap system on the user's body, the user's hands are left free to operate the electronic device.

BACKGROUND OF THE PRESENT INVENTION

Given the profusion of portable computing and similar devices, many items have been invented to accommodate the use of these devices "on the road." These items include a variety of carrying cases, portable desks, computer bags, and other configurations. Yet what these devices fail to provide is a device that can be worn as a backpack and open into a platform suspended from front of the user's body, so that the user's hands are free to operate the device.

U.S. Pat. No. 5,762,250 issued to Carlton et al. on Jun. 9, 1998 is a convertible carrying case and work platform for a portable electronic device. Carlton et al. has a case structure that holds the electronic device and can be configured to hang suspended from the user's body. Unlike the present invention, Carlton et al. is not configured to be carried as a backpack but must be carried as a conventional bag when transporting the device.

U.S. Pat. No. 6,354,477 issued to Trummer on Mar. 12, 2002 is for a carrying bag for a portable personal computer such as a laptop computer. Trummer can be configured for carrying as a briefcase, shoulder bag or backpack, but unlike the present invention, cannot be shifted around to the user's front in order to hang suspended from the user as a platform for operating the laptop computer.

U.S. Pat. No. 5,706,992 issued to Moor on Jan. 13, 1998 is for a backpack for carrying a laptop computer. Moor has a compartment for storing a laptop computer in the interior of the backpack, and the backpack opens in the user's lap so that the laptop computer can be used there. Adjustable shoulder straps are connected to the exterior of the rear panel for carrying the backpack. Unlike the present invention, Moor cannot be shifted around to the user's front in order to hang suspended from the user as a platform for operating the laptop computer.

U.S. Pat. No. 6,269,948 issued to Jackson on Aug. 7, 2001 is a protective transport case for a computing device that opens up in the user's lap for use. Unlike the present invention, Jackson is not designed to be carried as a backpack, and is not designed to be suspended from the user's body as a platform to serve as a workstation.

U.S. Pat. No. 5,447,215 issued to Volkmar et al. on Sep. 5, 1995 is for a portable desk with storage area. Unlike the present invention, Volkmar et al. is not configured to be carried as a backpack, or hang suspended from the user's body as a platform on which the user can perform computing and other tasks.

SUMMARY OF THE PRESENT INVENTION

The goal of the present invention is to make it easier to use a laptop computer or similar device in a transitory environment. A user will not have to risking the device being dropped, lost, forgotten or stolen. With the present invention, it can be both stored and easily accessible for use at the same time.

The objectives of the present invention are accomplished by means of a backpack with a carrying case for a laptop computer or similar device. The case works in conjunction with a strap system that allows the user to wear the case on his or her back for transport, then to move the case to the front of his or her body for use. When positioned at the front of the user's body, the case opens to provide a platform on which a laptop computer or similar device can be used.

The present invention comes in two main parts, a first portion which is stationary and a second portion which is mobile. The first portion is worn as a conventional backpack, with conventional adjustable arm straps the user places over his or her shoulders. On the rear of the first portion are grooves, or receptacles, in which the second portion fits when it is moved to the user's back. Also part of the second portion are two straps that pass through and extend outward from the second portion, and attach by conventional means around the user's torso. These straps serve as "tracks" on which the second portion is moved from the rear to the front of the user's body. Once the straps are attached and tightened to fit the user's torso, the user slides the second portion along the straps to the front of the user's body. Once in position at the front of the user's body, the case on the second portion can be opened up to form a platform that hangs suspended from the user's body. On this platform, the user can operate a laptop computer or other device. After the user has finished, the second portion can be closed and moved to the user's back, where it will fit securely in the first portion.

DETAILED DESCRIPTION OF THE PRESENT INVENTION

The present invention is a backpack that holds a laptop computer or similar device and is designed to lower into a platform that extends from the user's body at an approximate right angle, giving the user a surface on which to operate the laptop computer or similar device. The present invention has numerous parts, but chief among them are a first portion (30) and a second portion (40), which are briefly explained in FIGS. 1, 2 and 3 below.

Figure 1:
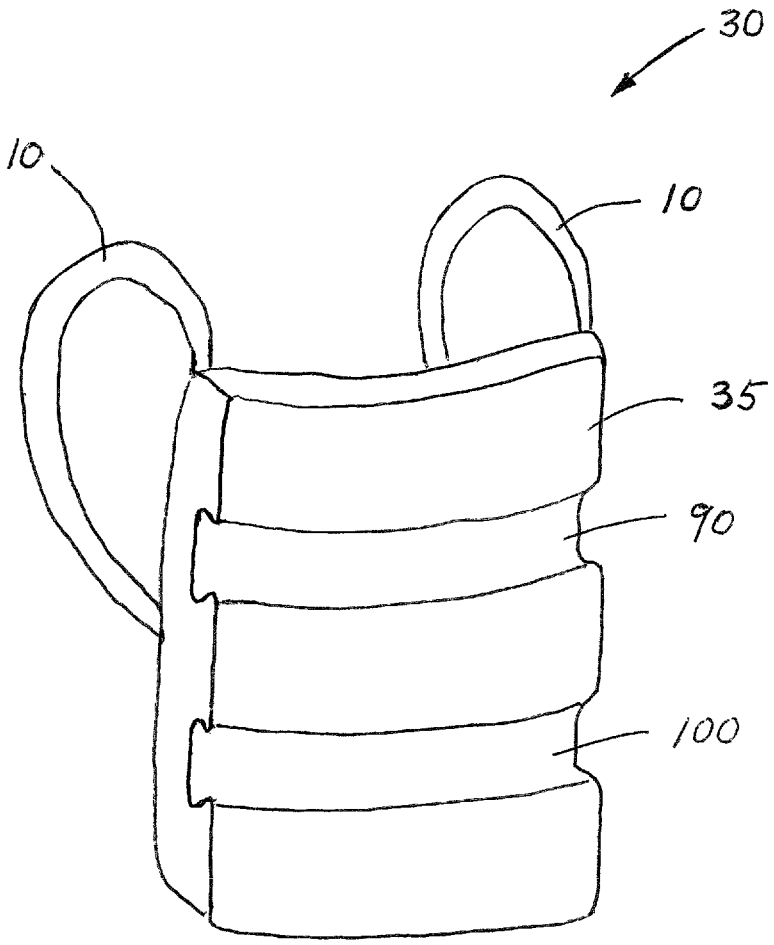
FIG. 1 shows a view of the first portion (30) of the present invention.

FIG. 1 shows the first portion (30). The first portion (30) is composed of a first molded piece (35) made of hard plastic or similar material that is connected to conventional arm straps (10) that the user places over his or her shoulders. The first portion (30) is worn on the user's back like a conventional backpack, and in one embodiment is curved to more comfortably contour to the user's back. On the outward side of the first portion (30) are a top-most receptacle (90) and a bottom-most receptacle (100) into which will be inserted runners (70 and 80) (see FIG. 2) that are part of the second portion (40) (see FIG. 2).

Figure 2:
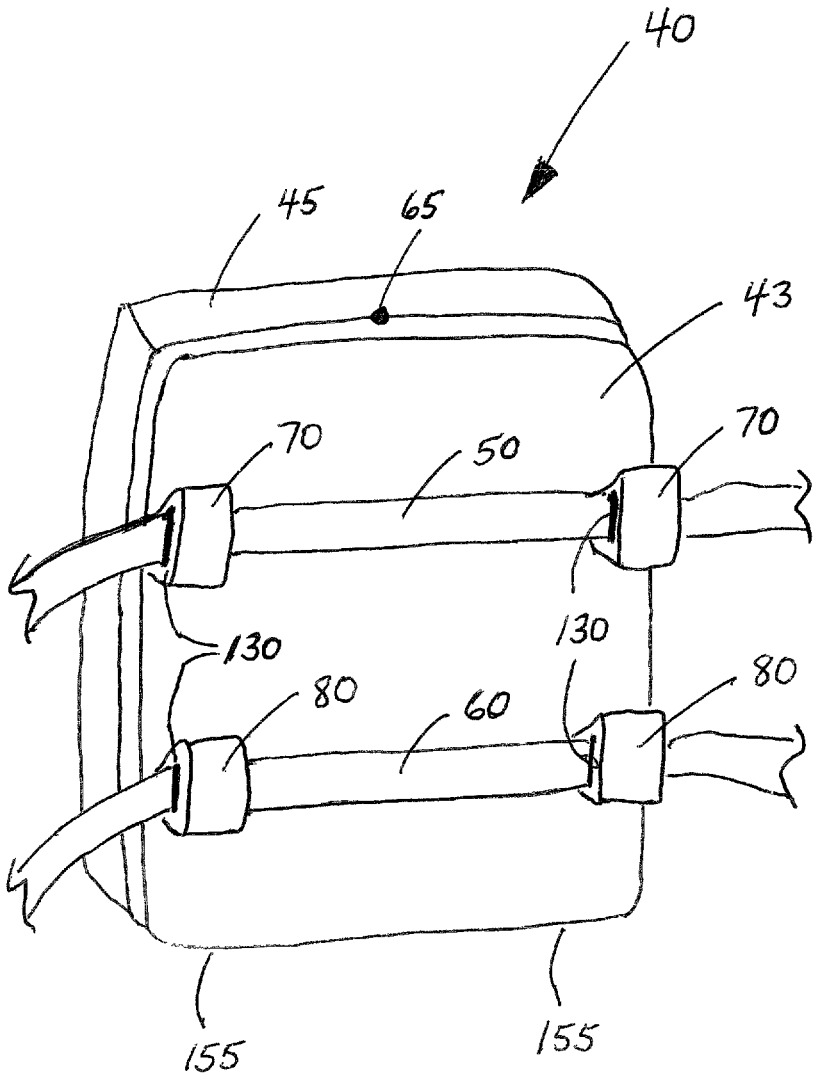
FIG. 2 shows a view of one side of the second portion (40) of the present invention.

FIG. 2 shows a view of the second portion (40) of the present invention. The second portion (40) has a second molded piece (43) made of hard plastic or similar material. Extending outward from the second molded piece (43) are at least four identical runners, at least two top-most runners (70) and at least two bottom-most runners (80), also shaped from hard plastic or similar material. When the second portion (40) is moved to the user's back, the at least two top-most runners (70) will be inserted into the top-most receptacle (90) of the first portion (30) (see FIG. 1) and the at least two bottom-most runners (80) will be inserted into the bottom-most receptacle (100) of the first portion (30) (see FIG. 1). Inside the runners (70 and 80) are formed strap slots (130) through which straps (50 and 60) are passed. These straps (50 and 60) wrap around the torso of the user to keep the present invention secured to the user. At the summit of the second portion (40) can be seen the top-most portion of the case (45). The case (45) connects to the second molded piece (43) by means of at least one hinge (155) (not visible in FIG. 2) placed at the base of the second molded piece (43) and the base of the case (45). At the summit of the second portion (40), the second molded piece (43) and the case (45) are connected by means of a clasp (65) or other conventional fastener. Opening the clasp (65) will release the case (45) from the second molded piece (43) so that the case (45) will lower into a platform position extending at an approximate right angle from the second molded piece (43). The at least one hinge (155) (not visible in FIG. 2) will lower the case (45) into a platform position extended outward from the second molded piece (43).

Figure 3:
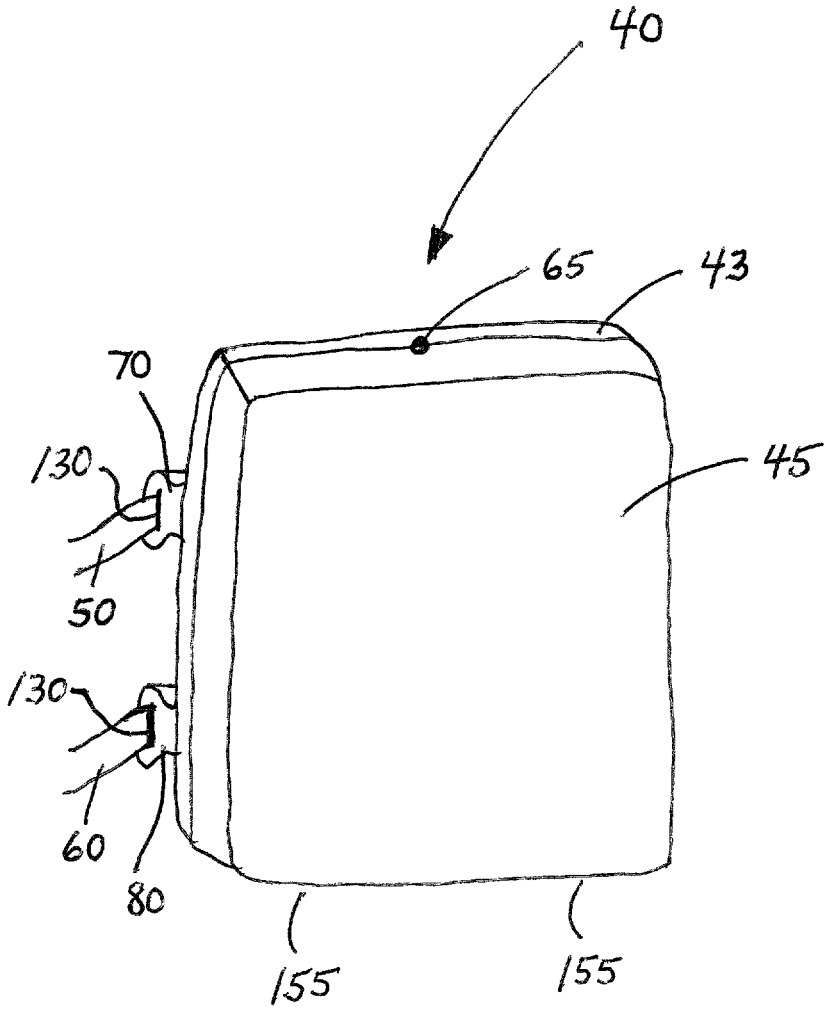
FIG. 3 shows an opposite view of the second portion (40) of the present invention.

FIG. 3 shows an opposite view of the second portion (40) of the present invention. The second portion (40) has a second molded piece (43) made of hard plastic or similar material. At the front of the second portion (40) is shown the case (45) in the closed position, fastened to the second molded piece (43) at the clasp (65). Opening the clasp (65) will release the case (45) from the second molded piece (43) so that the case (45) will lower into a platform extending at an approximate right angle from the second molded piece (43). The at least one hinge (155) (not visible in FIG. 3) that connects the second molded piece (43) to the case (45) is located on the base of the second molded piece (43) and the base of the case (45). This at least one hinge (155) will lower the case (45) into a platform extended outward from the second molded piece (43). One of the top-most runners (70) and one of the bottom-most runners (80) are visible in FIG. 3, each of the runners (70 and 80) having a strap slot (130) through which the straps (50 and 60) pass through the runners (70 and 80).

Figure 4:
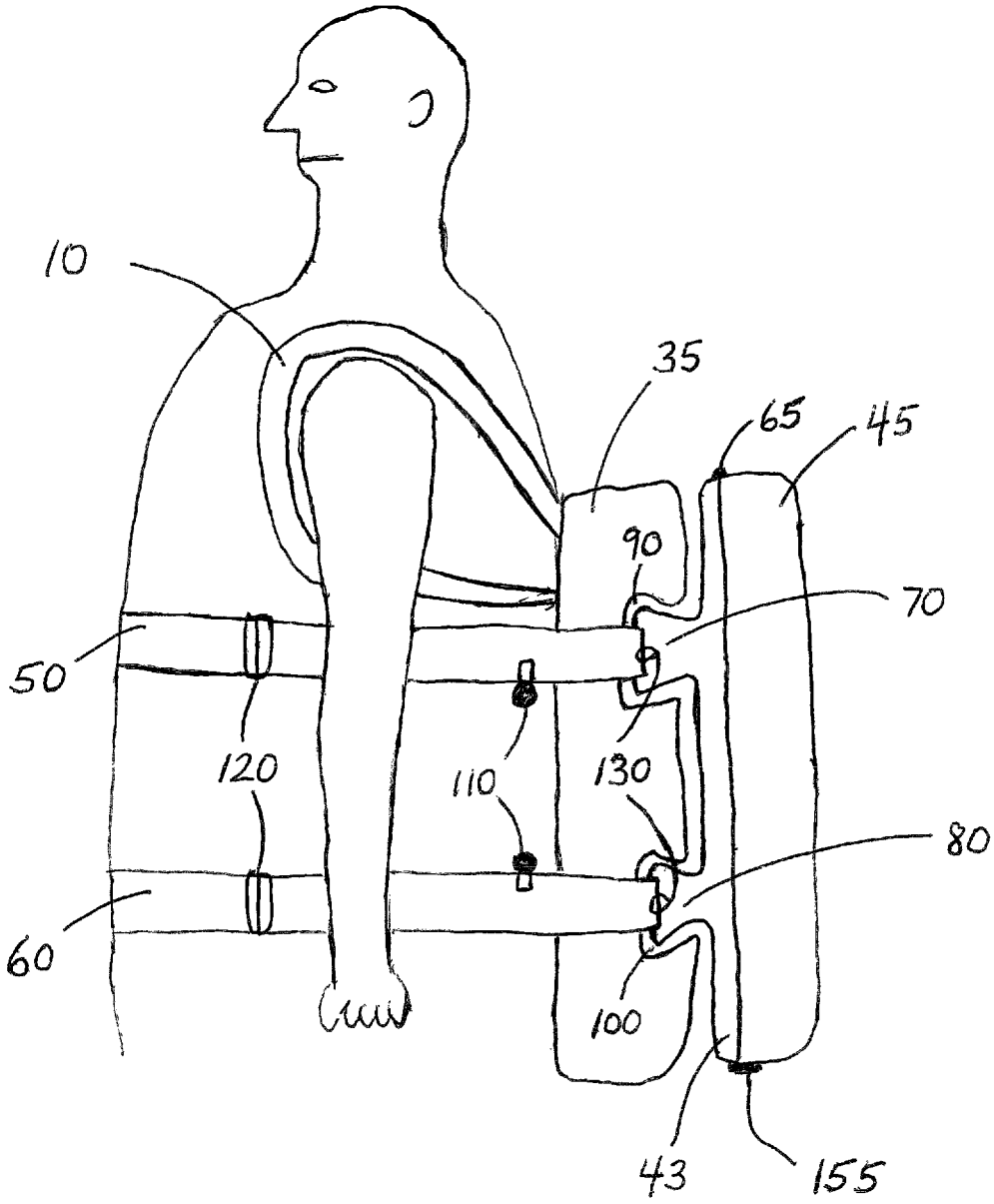
FIG. 4 shows a view of the user's left side while the user is wearing the present invention at the rear of the user's body.

FIG. 4 shows a view of the user's left side while the user is wearing the present invention at the rear of the user's body. Attached to the first molded piece (35) is the second molded piece (43) and its attached case (45). The case (45) and the second molded piece (43) are attached at the summit of each by a clasp (65), and at the base of each by at least one hinge (155). The user puts on the present invention by means of the arm straps (10). The user then places the first strap (50) and the second strap (60) around the user's torso, attaching each strap on the left side of the user's torso by means of conventional buckles (120). The first strap (50) passes through the strap slots (130) in the top-most runners (70) of the second molded piece (43), and the second strap (60) passes through the strap slots (130) in the bottom-most runners (80) of the second molded piece (43). (Only one of the top-most runners (70) and one of the bottom-most runners (80) are visible in FIG. 4.) When the second molded piece (43) with its attached case (45) is moved to the user's back, the top-most runners (70) fit into the top-most receptacle (90) of the first molded piece (35), and the bottom-most runners (80) fit into the bottom-most receptacle (100) of the first molded piece (35). Once moved to the user's back, the second molded piece (43) with its attached case (45) can be held in position within the first molded piece (35) by means of conventional clips (110) placed on the first strap (50) and second strap (60).

Figure 5:
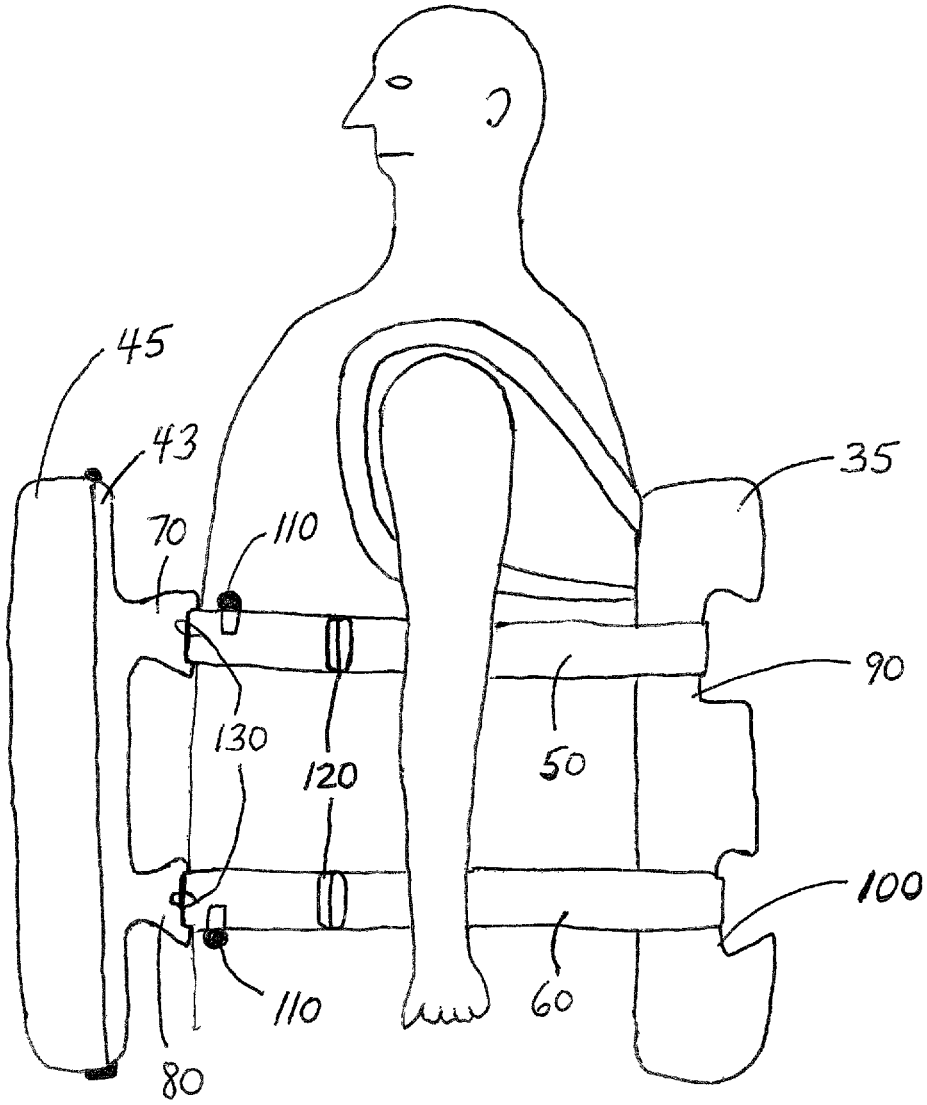
FIG. 5 shows a view of the user's left side after the user has moved the second molded piece (43) and its attached case (45) to the front of the user's body via the right side of the user's body.

FIG. 5 shows a view of the user's left side after the user has moved the second molded piece (43) and its attached case (45) to the front of the user's body via the right side of the user's body. (The user cannot move the second molded piece (43) and its attached case (45) via the left side of the user's body because the conventional buckles (120), which fasten the straps (50 and 60) to the user's body, are located on the left side of the user's body.) The user lifts up his or her right arm and moves the second molded piece (43) and its attached case (45) along the straps (50 and 60) that are threaded through the strap slots (130) in the top-most runners (70) and bottom-most runners (80) of the second molded piece (43). An embodiment of the present invention envisions the runners (70 and 80) as slightly curved in order to better facilitate movement of the second molded piece (43) and its attached case (45) around the user's body. The second molded piece (43) is shown attached to the first strap (50) via the top-most runners (70), and to the second strap (60) via the bottom-most runners (80). (Only one of the top-most runners (70) and one of the bottom-most runners (80) are visible in FIG. 5.) At the rear of the user's body on the first molded piece (35), the first strap (50) is held in position by the top-most receptacle (90) and the second strap (60) is held in position by the bottom-most receptacle (100). Clips (110) are placed on the first strap (50) and second strap (60) to keep the second molded piece (43) in position at the front of the user's body. The second molded piece (43) is now in position so that the attached case (45) can be opened up in order to provide a platform for a laptop computer or similar device placed within the case (45), as shown in FIG. 6.

Figure 6:
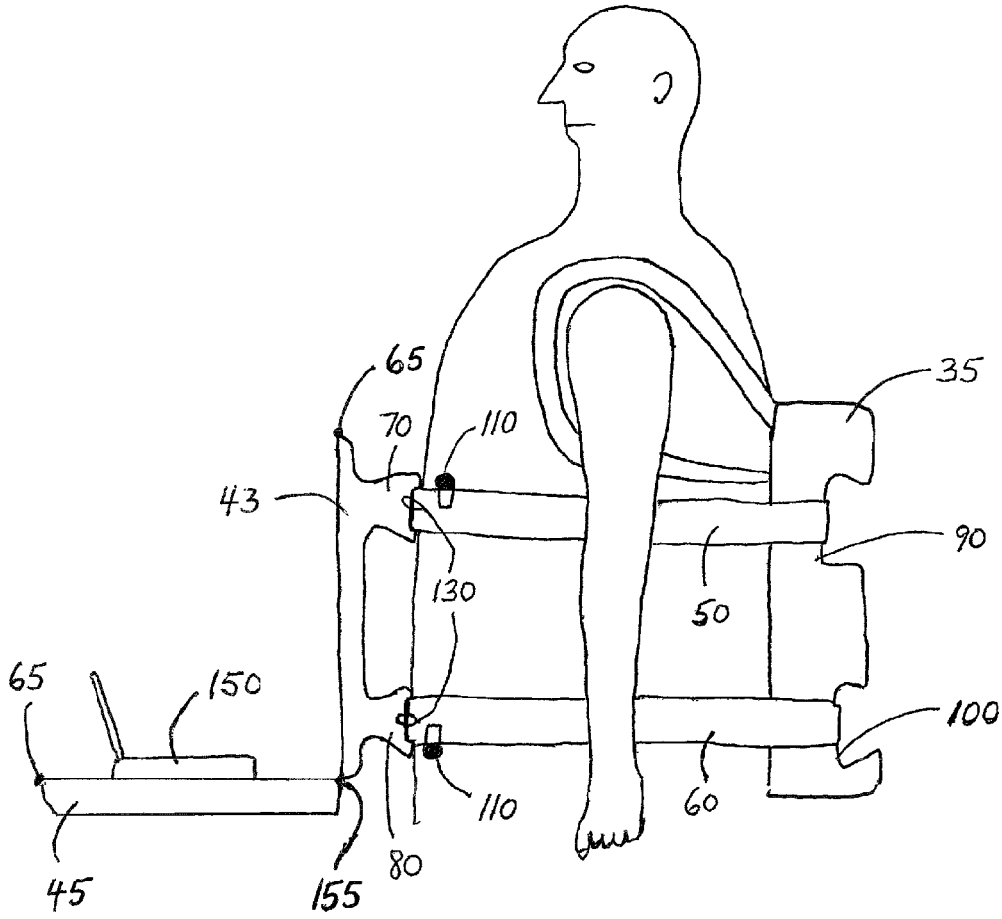
FIG. 6 shows a view of the user's left side after the user has moved the second molded piece (43) and its attached case (45) to the front of the user's body, and lowered the case (45) to provide a platform for the use of a laptop computer or similar device.

FIG. 6 shows a view of the user's left side after the user has moved the second molded piece (43) and its attached case (45) to the front of the user's body, and lowered the case (45) to provide a platform for the use of a laptop computer or similar device. The second molded piece (43) is shown attached to the first strap (50) via the top-most runners (70), and to the second strap (60) via the bottom-most runners (80). (Only one of the top-most runners (70) and one of the bottom-most runners (80) are visible in FIG. 6.) At the rear of the user's body, on the first molded piece (35), the first strap (50) is held in position by the top-most receptacle (90) and the second strap (60) is held in position by the bottom-most receptacle (100). In order to lower the case (45) into the platform position, the user detaches the clasp (65) connecting the summit of the second molded piece (43) to the summit of the case (45). The case (45) then lowers into position by means of at least one hinge (155) connecting the base of the case (45) to the base of the second molded piece (43). The case (45) holds in place a laptop (150) or similar electronic device, and the laptop (150) is revealed affixed to the inside of the case (45) when the case (45) is lowered. The laptop (150) can be affixed to the inside of the case (45) by conventional means, such as hook-and-loop fasteners. Also shown for purposes of illustration are the conventional clips (110) that keep the second molded piece (43) and case (45) in place at the front of the user's body.

In summary, the present invention is a laptop holding device, comprising a first portion (30) configured to attach to a user's body, and a second portion (40) configured to move between a first position behind the user and a second position in front of the user. The first portion (30) comprises arm straps (10) and a first molded piece (35) in communication with the arm straps (10). The second portion (40) comprises a case (45) configured to secure in place a laptop computer or other electronic device, a second molded piece (43) in communication with the case (45), a first strap (50) in communication with the second molded piece (43), and a second strap (60) in communication with the second molded piece (43).

In addition, the second molded piece (43) is configured to engage the first molded piece (35) such that the second molded piece (43) is held in a fixed position, and to disengage from the first molded piece (35) such that the second molded piece (43) is not held in a fixed position. The first molded piece (35) is fitted with a top-most receptacle (90) and a bottom-most receptacle (100), and the first strap (50) and second strap (60) are designed to fasten around the torso of the user by means of conventional buckles (120). The first strap (50) and second strap (60) are the means by which the second portion (40) is moved from the rear of the user's body to the front of the user's body, and from the front of the user's body to the rear of the user's body. The top-most receptacle (90) and bottom-most receptacle (100) hold in place the second portion (40) when the second portion (40) is moved to the back of the user's body, and hold in place the first strap (50) and the second strap (60) when the second portion (40) is moved to the front of the user's body.

Furthermore, the second molded piece (43) is fitted with at least two top-most runners (70) and at least two bottom-most runners (80). The top-most runners (70) are made of molded plastic or similar material and designed to fit into the top-most receptacle (90) of the first molded piece (35). The bottom-most runners (80) are made of molded plastic or similar material and designed to fit into the bottom-most receptacle (100) of the first molded piece (35). Each of the top-most runners (70) has a strap slot (130) through which passes the first strap (50), and each of the bottom-most runners (80) has a strap slot (130) through which passes the second strap (60). The case (45) and the second molded piece (43) of the second portion (40) are in communication at their bases by means of at least one hinge (155), and the case (45) and the second molded piece (43) of the second portion (40) are in communication at their summits by means of at least one clasp (65). Finally, the case (45) is configured to lower into a platform suspended from the second molded piece (43).

The invention claimed is:

1. A laptop holding device, comprising:
a first portion configured to attach to a user's body;
a second portion, said second portion configured to move between a first position behind the user and a second position in front of the user;
said first portion, comprising:
arm straps; and
a first molded piece in communication with said arm straps;
said second portion, comprising:
a case configured to secure in place a laptop computer or other electronic device; a second molded piece in communication with said case;
a first strap in communication with said second molded piece; and
a second strap in communication with said second molded piece;
said first molded piece fitted with a top-most receptacle and a bottom-most receptacle; and
said top-most receptacle and said bottom-most receptacle holding in place said second portion when said second portion is moved to the back of the user's body.

2. A laptop holding device, comprising:
a first portion configured to attach to a user's body;
a second portion, said second portion configured to move between a first position behind the user and a second position in front of the user;
said first portion, comprising:
arm straps; and
a first molded piece in communication with said arm straps;
said second portion, comprising:
a case configured to secure in place a laptop computer or other electronic device;
a second molded piece in communication with said case;
a first strap in communication with said second molded piece; and
a second strap in communication with said second molded piece;
said first molded piece fitted with a top-most receptacle and a bottom-most receptacle; and
said top-most receptacle and said bottom-most receptacle holding in place said first strap and said second strap when said second portion is moved to the front of the user's body.

3. A laptop holding device, comprising:
a first portion configured to attach to a user's body;
a second portion, said second portion configured to move between a first position behind the user and a second position in front of the user;
said first portion, comprising:
arm straps; and
a first molded piece in communication with said arm straps;
said second portion, comprising:
a case configured to secure in place a laptop computer or other electronic device;
a second molded piece in communication with said case;
a first strap in communication with said second molded piece; and
a second strap in communication with said second molded piece; and
said second molded piece fitted with at least two top-most runners and at least two bottom-most runners.

4. The laptop holding device of claim 3, said top-most runners made of molded plastic or similar material and designed to fit into the top-most receptacle of the first molded piece.

5. The laptop holding device of claim 3, said bottom-most runners made of molded plastic or similar material and designed to fit into the bottom-most receptacle of the first molded piece.

6. The laptop holding device of claim 3, said top-most runners having a strap slot through which passes said first strap.

7. The laptop holding device of claim 3, said bottom-most runners having a strap slot through which passes said second strap.

* * * * *